US005417029A

United States Patent [19]

Hugus et al.

[11] Patent Number: 5,417,029

[45] Date of Patent: May 23, 1995

[54] DOOR ASSEMBLY

[75] Inventors: William S. Hugus, Latrobe; Donald C. Smeltzer, Greensburg, both of Pa.

[73] Assignees: Reese, Jr. John D.; Timothy T. Reese, both of Greensburg, Pa.

[21] Appl. No.: 85,582

[22] Filed: Jun. 30, 1993

[51] Int. Cl.[6] ..... E04C 2/34

[52] U.S. Cl. ..... 52/802; 52/805; 52/821; 49/501

[58] Field of Search ..... 49/501; 52/802, 805, 52/821, 823, 824

[56] References Cited

U.S. PATENT DOCUMENTS

| | | | |
|---|---|---|---|
| 1,810,321 | 6/1931 | Michelman | 52/805 |
| 1,928,034 | 9/1938 | Schulstadt . | |
| 2,297,609 | 9/1942 | Clark et al. | 52/805 |
| 2,787,345 | 4/1957 | Soubier et al. | 52/802 |
| 3,153,817 | 10/1964 | Pease, Jr. | 52/802 |
| 3,273,297 | 9/1966 | Wehe . | |
| 3,295,273 | 1/1967 | Wehe . | |
| 3,319,738 | 5/1967 | Wehe . | |
| 3,336,713 | 8/1967 | Privas | 52/802 |
| 3,583,118 | 6/1971 | Lowery . | |
| 3,785,103 | 1/1974 | Turner . | |
| 3,786,609 | 1/1974 | Difazio | 52/802 |
| 3,786,613 | 1/1974 | Shepheard | 52/802 |
| 3,834,101 | 9/1974 | Wilder . | |
| 3,934,382 | 1/1976 | Gartung . | |
| 4,140,824 | 2/1979 | Gaillard . | |
| 4,155,211 | 5/1979 | Saylor . | |
| 4,194,329 | 3/1980 | Wendt . | |
| 4,265,067 | 5/1981 | Palmer . | |
| 4,318,453 | 3/1982 | Rose et al. . | |
| 4,374,693 | 2/1983 | Pitt . | |
| 4,446,663 | 5/1984 | Stumpf . | |
| 4,589,240 | 5/1986 | Kendall . | |
| 4,602,466 | 7/1986 | Larson . | |
| 4,657,798 | 4/1987 | Guilhem . | |
| 4,765,105 | 8/1988 | Tissington . | |
| 4,774,119 | 9/1988 | Imhoff . | |
| 4,807,411 | 2/1989 | Capaul . | |
| 4,860,512 | 8/1989 | Thorn . | |
| 4,922,674 | 5/1990 | Thorn . | |
| 5,020,292 | 6/1991 | Strom . | |
| 5,074,087 | 12/1991 | Green . | |
| 5,077,948 | 1/1992 | Olson . | |
| 5,142,835 | 9/1992 | Mrocca . | |

FOREIGN PATENT DOCUMENTS

| | | |
|---|---|---|
| 851003 | 9/1970 | Canada . |
| 858917 | 12/1970 | Canada . |

OTHER PUBLICATIONS

John W. Kopec, "Pushing the Limits of Acoustical Barrier Performance", *NOISE-CON 90*, The University of Texas, Oct. 15-17, 1990, pp. 127-132.

*Primary Examiner*—Carl D. Friedman
*Assistant Examiner*—Wynn E. Wood

[57] ABSTRACT

A door (10) includes a front panel (18) and a back panel (24). The front panel and back panel are secured together by connecting members (42 and 44) which are connected by weld (82). Panels (18 and 24) include sides (32 and 38) that are dimensioned to maintain cover strip (90) therebetween. Cover strip (90) conceals the welds (82) that result in a smooth finish for the side of door (10). Panels (18 and 24) are also joined by connecting members (92, 104, 120 and 122) and welds (116 and 144). A channel member (118) is maintained between connecting members (92 and 104) to conceal weld (116). Support members (154 and 160) are also provided to panels (18 and 24).

10 Claims, 4 Drawing Sheets

DOOR ASSEMBLY

BACKGROUND OF THE INVENTION

1. Field of the Invention

The subject invention relates to hollow metal doors and, more particularly, metal doors that are of improved design so as to limit the need for detail finishing of welding deformations while maintaining structural integrity of the doors. This design also provides a door with relatively high attenuation of sound but relatively low weight.

1. Description of the Prior Art

Many types of doors have been designed and manufactured in the prior art. Some of these designs were intended, in whole or in part, to limit the degree of finish work that was required to produce a door with a commercially acceptable appearance. The designs varied depending, in part, on the materials from which the door was constructed.

In the case of hollow metal doors, the doors were often constructed of two opposing panels that were fastened together by means of rivets or welds or the like. Usually, there was also some internal reinforcement that was welded to the inside of the door panels to improve the rigidity and other properties of the door or to meet certain industry standards or certification requirements.

One problem with the riveted or welded designs was that the riveting or welding process would often cause local deformation of the door panels that would degrade the appearance of the finished door. To overcome this, the door manufacturer was required to hand-finish the deformed areas by filling and sanding or by other similar methods for finishing the surface of the door panels. In some instances, as for example with brushed stainless steel, these conventional finishing methods could not be used and more elaborate refinishing measures were required. These finishing processes significantly increased the time and cost for manufacturing the door. Accordingly, there was a need in the prior art for a door construction that would avoid disfigurement of the door panels during construction and thereby limit the need for hand finishing of hollow metal doors.

Also in the prior art, there were numerous door designs that were intended to have especially effective sound attenuation properties. Such door designs were developed for applications such as security areas and sound recording studios. Generally, these designs taught that to improve sound attenuation properties, it was necessary to increase the mass of the door. Examples are shown in U.S. Pat. Nos. 3,273,297 and 3,319,738 which disclose the use of a lead sheath inside the door to increase sound attenuation of the door. Other examples are described in U.S. Pat. No. 3,834,487; 4,146,999; and 4,807,411.

According to such teachings, doors that were said to provide high sound attenuation were relatively heavy. This greater weight was the source of many disadvantages. For example, the heavier doors were more difficult to handle and mount and often required structural reinforcement and other custom adaptations. Also, the heavier doors were more expensive to manufacture and ship, and more difficult to operate. To overcome these difficulties and disadvantages, prior art doors incorporated special closure mechanisms and other accessory devices that further increased the cost and installation difficulty.

More recently, additional methodologies such as described in "Pushing the Limits of Acoustical Barrier Performance", John W. Kopec, *Noise-Con* 90, Univ. of Texas, Oct. 15–17, 1990, pp. 127–132, have been suggested for augmenting sound transmission loss in architectural applications. However, such articles did not describe any structure by which such methodologies could be implemented. Accordingly, there was also a need in the prior art for a door that afforded high sound attenuation, but avoided the disadvantages of the heavier doors.

SUMMARY OF THE INVENTION

The presently disclosed invention is a door assembly wherein a front panel and a back panel are maintained in spaced-apart relationship by a front connecting member and a back connecting member that are secured together. The front connecting member includes a base segment that is secured to the front panel and an extension segment. The back connecting member includes a base segment that is secured to the back panel and an extension segment that is secured to the extension segment of the front connecting member. A cover is respective base segments of the front and back connecting members.

Preferably, the base segment of said front connecting member includes a flange portion that is connected to the front extension segment and a front support member that is secured to both the flange portion of the base segment and to the interior surface of the front panel. The base segment of said back connecting member includes a flange portion that is connected to the back extension segment and a back support member that is secured to both the flange portion of the base segment and to the interior surface of the back panel.

Also preferably, the door assembly includes a front support member that is connected to the inner face of the front panel by an adhesive and back support member that is connected to the inner face of the front panel by an adhesive and back support member that is connected to the inner face of said back panel by an adhesive.

Other details, objects and advantages of the present invention will become apparent as the following description of the presently preferred embodiment proceeds.

DESCRIPTION OF THE DRAWINGS

The accompanying drawings illustrate a presently preferred embodiment of the invention in which.

PREFERRED EMBODIMENT OF THE INVENTION

Figure 1:
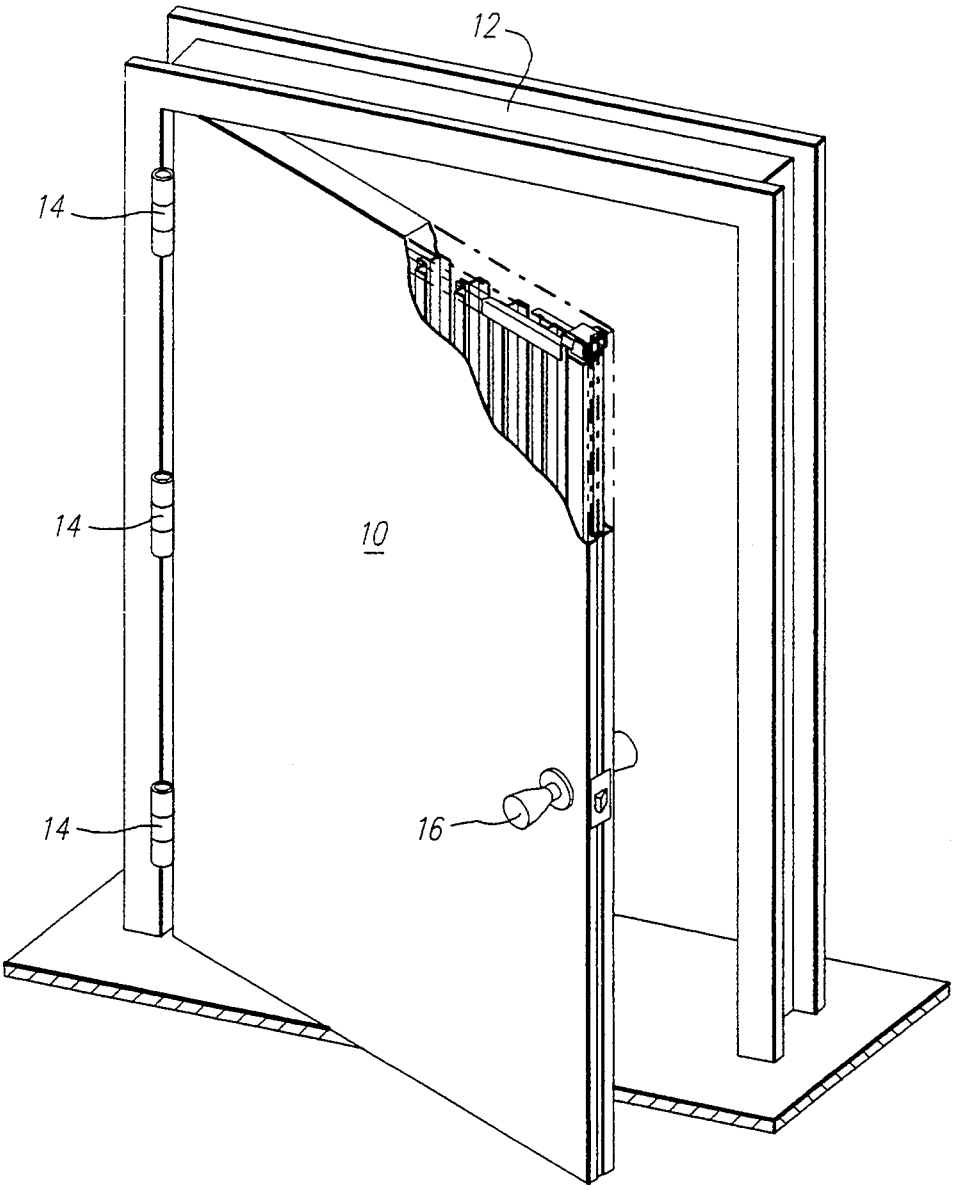
FIG. 1 is a perspective view of a door and frame assembly that is constructed in accordance with the present invention, portions of which have been broken away.
Figure 2:
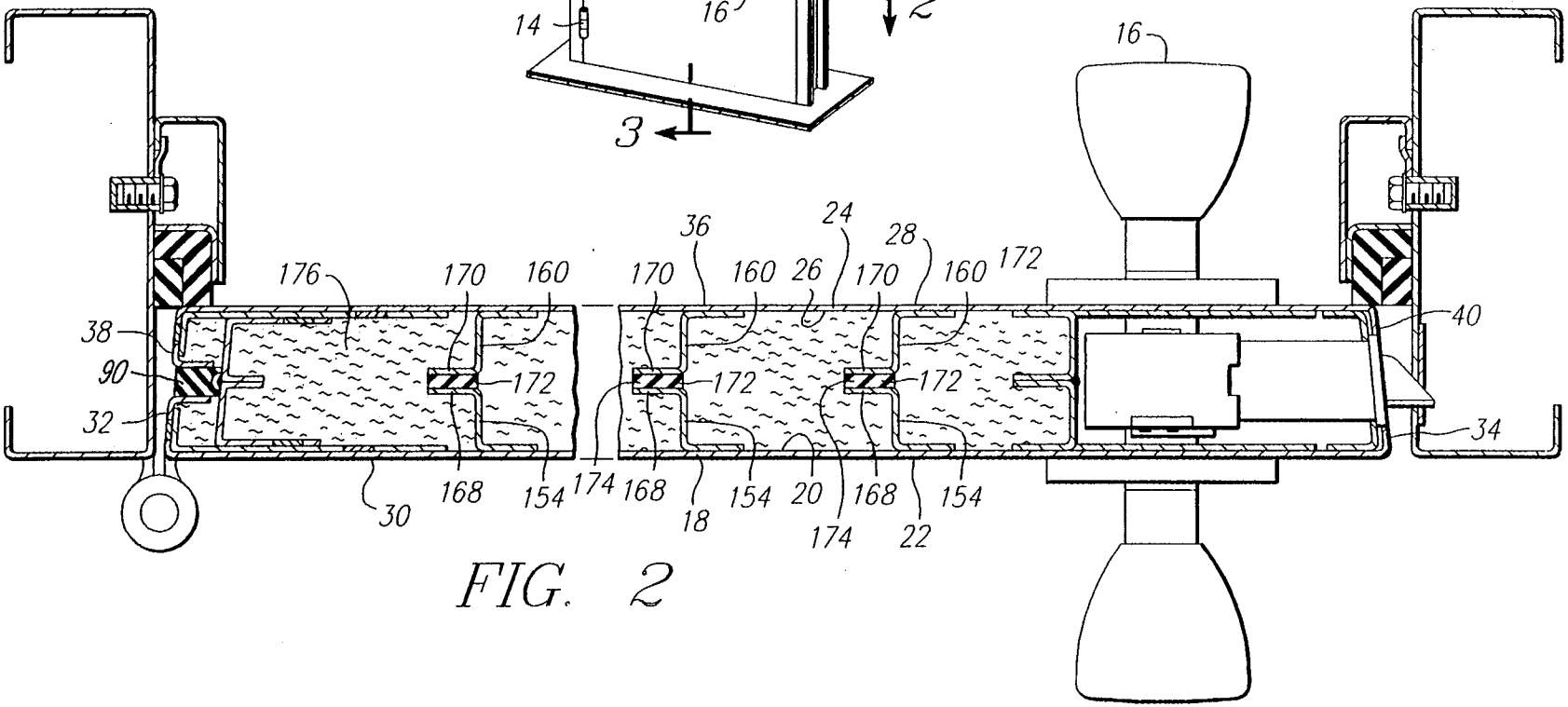
FIG. 2 is cross-section of the door and frame assembly shown a in FIG. 1A taken along the lines 2—2 of FIG. 1A.
Figure 1B:
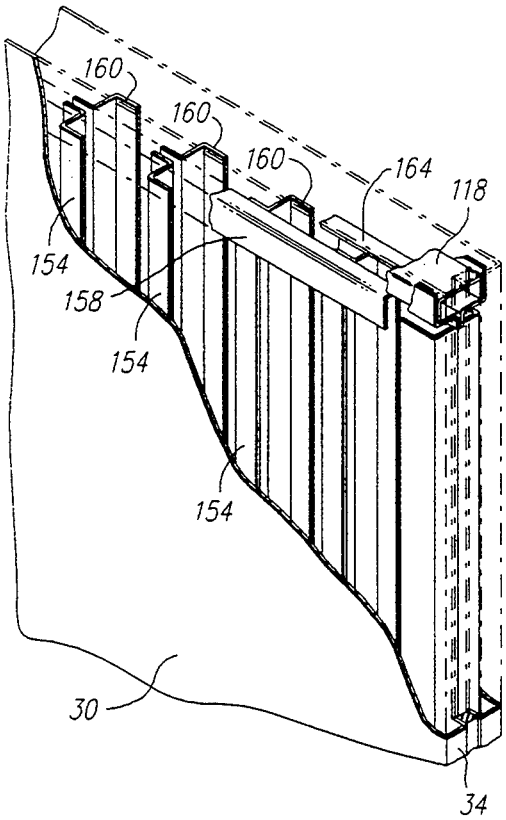
FIG. 1B is an enlarged view of a portion of the door and frame assembly shown in FIG. 1 with emphasis on the portion that has been broken away to better disclose internal structures.

As shown in FIGS. 1 and 2, a door 10 in accordance with the present invention is constructed to standard dimensions and proportions and is suitable for use with a standard door frame 12 without requirements for complicated and expensive modifications or customized hardware. Hinges 14 and lockset 16 are also standard materials.

Figure 4:
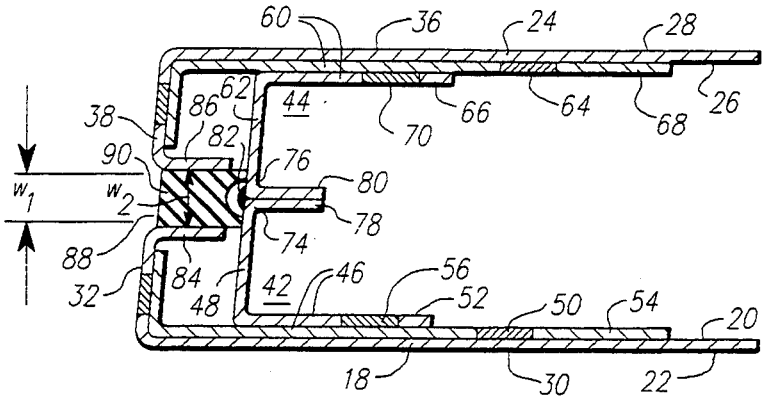
FIG. 4 is an enlarged view of a portion of the door shown in FIG. 2 with emphasis on details of the door construction.
Figure 5:
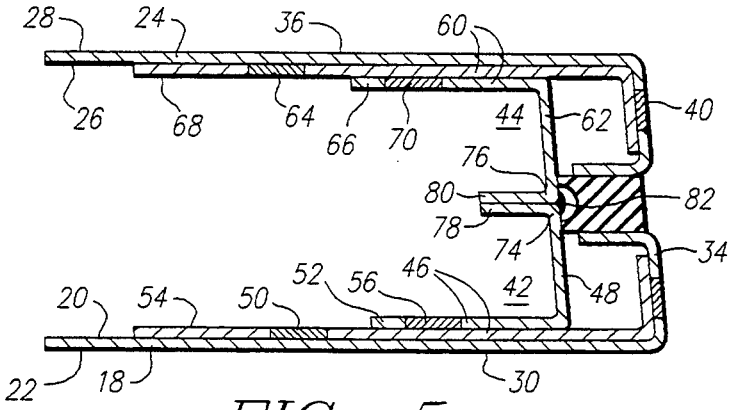
FIG. 5 is an enlarged view of a portion of the door shown in FIG. 2 with emphasis details of the door construction.

As shown in FIGS. 2, 4 and 5, door 10 includes a front panel 18 that has an interior surface 20 and an exterior surface 22. Also included is a back panel 24 having an interior surface 26 and an exterior surface 28. Back panel 24 is spaced apart from front panel 18 and is substantially parallel thereto with interior surface 20 of front panel 18 in opposed or facing relationship with interior surface 26 of back panel 24. Front panel 18 and back panel 24 are secured together in accordance with structure that is hereafter more particularly disclosed.

As also shown in FIGS. 2, 4 and 5, front panel 18 includes a face portion 30 and side portions 32 and 34. In the preferred embodiment, sides 32 and 34 are integrally connected to face 30 and are out of the plane of face 30 such that the interior surface of the front panel face 30 cooperates with the interior surface of each front panel edge 32 and 34 to define an angle therebetween. In the preferred embodiment, that angle is substantially a right angle although other angles could be used.

Similarly, back panel 24 includes a face portion 36 and side portions 38 and 40. In the preferred embodiment, sides 38 and 40 are integrally connected to face 36 and are out of the plane of face 36 such that the interior surface of the back panel face 36 cooperates with the interior surface of each back panel edge 38 and 40 to define an angle therebetween. Again, the angle is substantially a right angle.

As previously referred to, front panel 18 is secured to back panel 24 by means of at least one front connecting member 42 and at least one back connecting member 44. Front connecting member 42 and back connecting member 44 are located or aligned substantially parallel to sides 32, 34 and sides 38, 40 respectively. FIGS. 4 and 5 show that front connecting member 42 includes a base segment 46 and an internally extending segment 48 that is connected to base segment 46. Base segment 46 is in contact with interior surface 20 of front panel 18 and is secured to front panel 18 by a series of welds. Preferably, the number of welds is limited by use of a bond of adhesive material 50 in combination therewith. In applications where thermal exposure criteria is inapplicable, a bond of adhesive material alone can be used.

As more particularly disclosed in the presently preferred embodiment, base segment 46 further includes a flange portion 52 that is integrally connected to front extension segment 48. Base segment 46 also includes a front support member 54 that is secured to flange portion 52 by series of welds. The welds may be used in combination with a bond of adhesive material 56. Alternatively, the bond of adhesive material alone can be used for applications in which thermal exposure is not a limiting criteria. Similarly, support member 54 is also secured to interior surface 20 of front panel 18 by welds or an adhesive bond 50 as explained above.

Similarly, back connecting member 44 includes a base segment 60 and an internally extending segment 62 that is connected to base segment 60. Base segment 60 is in contact with interior surface 26 of back panel 24 and is secured to back panel 24 by welds or a bond of adhesive material 64 in the manner explained with regard to base segment 46 and front panel 18. Base segment 60 further includes a flange portion 66 that is integrally connected to back extension segment 62. Base segment 60 also includes a back support member 68 that is secured to flange portion 66 by welds or by a bond of adhesive material 70 in the same manner as explained with regard to front support member 54 and flange portion 52. Back support member 68 is also secured to interior surface 26 of back panel 24 by welds or an adhesive bond 64 as explained above.

Extension segments 48 and 62 include distal edges 74 and 76 respectively. Distal edges 74 and 76 are in contact with each other and a fastening means such as weld 82 is provided for securing extension segment 48 to extension segment 62. Thus, connecting members 42 and 44 are also secured together. Panels 18 and 24 which are secured through welds and adhesive bonds to connecting members 42 and 44 are thus also secured in substantially parallel relationship.

In the preferred embodiment, distal edge 74 includes a lip 78 and distal edge 76 includes a lip 80. Lip 78 is in contact with lip 80 such that the two lips form an expanded bearing surface for distal edge 74 to contact distal edge 76. Lips 78 and 80 also help to dissipate heat at distal edges 74 and 76 at the time that weld 82 is made thus resulting in less deformation and a stronger connection.

As shown in FIG. 4, panels 18 and 24 include sides 32 and 38 respectively. Side 32 has a distal edge that is formed in a lip 84 and side 38 has a distal edge that is formed in a lip 86. Lip 84 is spaced apart from Lip 86 to form a gap therebetween. Front connecting member 42, back connecting member 44 and sides 32 and 38 are dimensioned such that the width $w_1$ of the gap between lips 84 and 86 is less than the nominal width $w_2$ of a cover strip 90, Therefore, cover strip 90 is compressively maintained between front lip 84 and back lip 86.

In accordance with this design, no weld deformations are caused in panels 18 and 24 because the portions of front connecting member 42 and back connecting member 44 that are in contact with panels 18 and 24 are secured thereto by welds or by adhesive bonds. The only welds are between extension segments 48 and 62. These welds are concealed during manufacture of the door by placement of cover strip 90 into gap 88. This is easily done without special tools and also results in a smooth finish for the exposed portions of cover strip 90. Base segments 46 and 60 provide sufficient strength and rigidity to panels 18 and 24 that door 10 can be mounted using conventional hinges 14 and lockset 16.

Figure 1A:
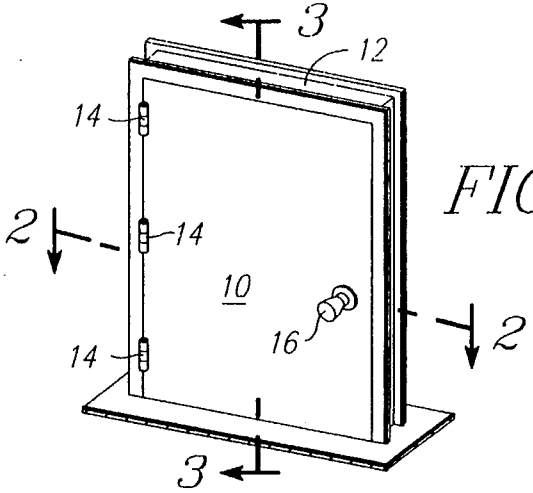
FIG. 1A is a perspective view of the door and frame assembly shown in FIG. 1.
Figure 3:
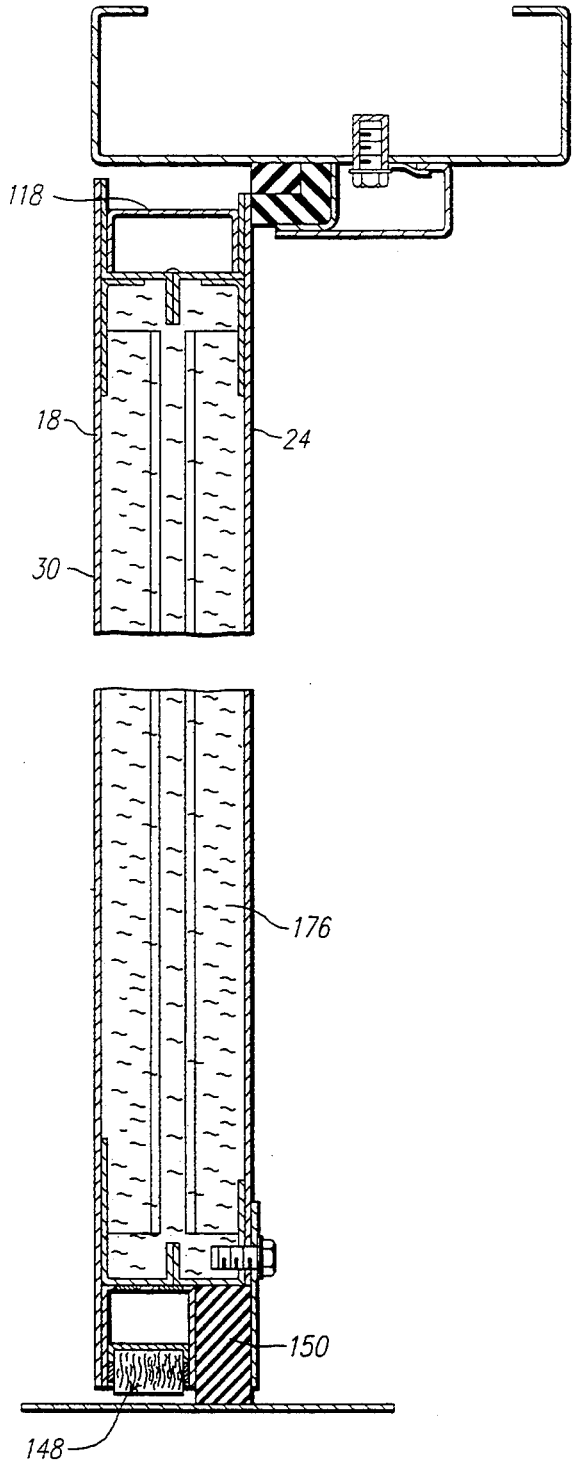
FIG. 3 is a cross-section of the door and frame assembly shown in FIG. 1A taken along the lines 3—3 of FIG. 1A.
Figure 6:
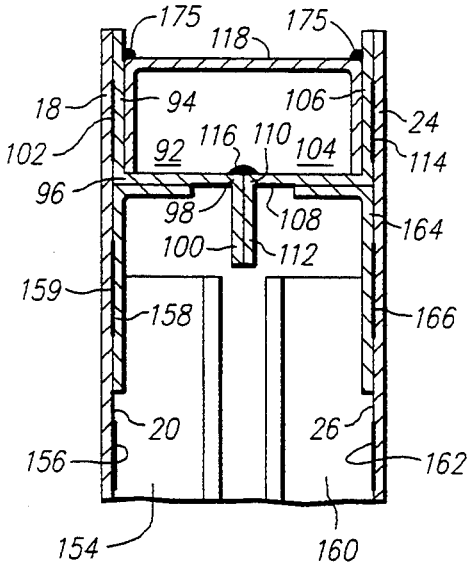
FIG. 6 is an enlarged view of a portion of the door shown in FIG. 3 with emphasis on details of the door construction.
Figure 7:
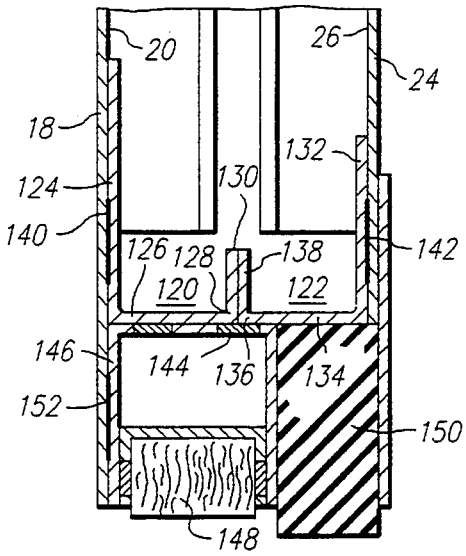
FIG. 7 is an enlarged view of a portion of the door shown in FIG. 3 with emphasis on details of the door construction.

The top and bottom of panels 18 and 24 are of different construction than the side edges. This requires an alternative arrangement for securing the front panel to the back panel and concealing the welds which is illustrated in the example of the preferred embodiment in FIGS. 3, 6 and 7. FIG. 3 shows a cross-section of door 10 taken along the lines 3—3 of FIG. 1A. FIGS. 6 and 7 show the top and bottom cross-sections respectively of door 10 taken along the lines 3—3 of FIG. 1A. At the top of door 10 as shown in FIGS. 3, 6 and 7, front panel 18 and back panel 24 have no sides. In FIGS. 3 and 6, a front connecting member 92 includes a base segment 94 that is integrally connected to an extension segment 96. A distal edge 98 of extension segment 96 is formed in a lip 100. Base segment 94 is in contact with interior surface 20 of front panel 18 and is secured to the surface by welds or a bond of adhesive material 102 hereinbefore described with respect to connecting member 42.

A back connecting member 104 includes a base segment 106 that is integrally connected to an extension segment 108. A distal edge 110 of extension segment 108 is formed as a lip 112. Base segment 106 is in contact with interior surface 26 of back panel 24 and is secured to the surface by welds or a bond of adhesive material 114 as hereinbefore described with respect to connecting member 44.

Distal edges 98 and 110 are fastened together by welds 116. To conceal weld 116 and to provide a flush edge, a cover made of channel member 118 is maintained between base segment 94 and base segment 106. Channel member 118 is inserted between base segments 94 and 106 and is maintained between by welds 175.

FIG. 7 shows the bottom of door 10 with another arrangement of a front connecting member 120 and a back connecting member 122. Front connecting member 120 includes a base segment 124 that is integrally connected to an extension segment 126 having a distal edge 128 in the form of a lip 130. Back connecting member 122 includes a base segment 132 that is integrally connected to an extension segment 134 having a distal edge 136 that is in the form of a lip 138.

Base segments 124 and 132 are respectively in contact with interior surfaces 20 and 26 of panels 18 and 24 and are secured to those surfaces by welds or bonds 140 and 142 of adhesive material in the manner previously explained with regard to connecting members 42 and 44. Extension segments 126 and 134 are fastened together by a weld 144.

FIG. 7, which shows the bottom cross-section of door 10 also includes a channel 146 that contains a felt seal 148 and a rubber sweep seal 150. Channel 146 is also secured to front panel by welds or a bond of adhesive material 152 in the manner previously explained with regard to connecting members 42 and 44. Channel 146, felt seal 148 and rubber sweep seal 150 are of construction that is known in the art.

In accordance with the present invention, door 10 can also be provided with various internal support members such as shown in FIGS. 1B, 2, 6 and 7. In FIGS. 1B, 2, 6 and 7 an array of support members 154 is secured to interior surface 20 of front panel 18 by adhesive bonds 156. Preferably a crosspiece 158 that is secured to interior surface 20 by an adhesive bond 159 is also included to provide added rigidity to panel 18. In addition, crosspiece 158 is notched at regular intervals with each notch dimensioned to receive the end of one support members 154 so that crosspiece 158 provides lateral separation between support members 154.

Also shown in FIGS. 1B, 2, 6 and 7, an array of support members 160 is secured to the interior surface 26 of back panel 24 by adhesive bonds 162. Preferably, is crosspiece 164 that is secured to interior surface 26 by an adhesive bond 166 is also included to provide added rigidity to panel 24. In addition, crosspiece 164 is notched at regular intervals with each notch dimensioned to receive the end of one of support members 160 so that crosspiece 164 provides lateral separation between support members 160.

It has been found that door 10 in accordance with the present invention has relatively high capacity for attenuating sound. This has been a surprising and unanticipated result because, in contrast to the teachings of the prior art and the practice of the industry, the sound attenuation is substantially increased without using high density or massive materials. Indeed, the result is precisely the opposite from what would be expected in accordance with the teaching of U.S. Pat. Nos. 3,273,297 and 3,319,738 and related prior art which indicate that an internal septum of high mass material should be used.

In further experimentation, it has been found that certain additional measures can be taken to increase the sound attenuation capacity of the door of the disclosed invention.

As another measure that has been found to increase the sound attenuation properties of the door of the present invention, it is preferred that the bonds of adhesive material formed in the disclosed construction be made of double-sided tape such as is commercially available from 3M Company. It is thought that such adhesive bonds increase sound attenuation by damping mechanical vibrations that propagate through the metal components of the door. Double-sided tape has been found to be more effective than liquid or paste adhesives in this respect.

As still another measure of increasing the sound attenuation properties of the door of the present invention, it is also preferred that welds 82 be non-continuous welds. Such non-continuous welds are also believed to be less transmissive of mechanical vibrations.

In accordance with the preferred embodiment, attenuator strips 174 are comprised of neoprene rubber or other porous and flexible material with similar physical properties. Such porous, flexible material is preferred in order to construct the internal supports of door 10 from low-density materials. Preferably, the durometer of attenuator strips as less than 60 and, more preferably, below 40.

When, as more particularly shown in FIG. 2, it is advantageous to provide additional internal support for panels 18 and 24, support members 154 and 160 are arranged to form beams in accordance with the preferred embodiment. FIG. 2 shows support members 154 have lip edges 168 and support members 160 have lip edges 170 with support members 154 and 160 being arranged on panels 18 and 24 respectively such that lip edges 168 are located opposingly and spaced apart from lip edges 170 to form a corresponding array of gaps 172 therebetween. An array of attenuator strips 174 are respectively located in gaps 172 and bonded to lip edges 168 and 170. Attenuator strips 174 can be continuous throughout gaps 172 or they may be a series of pads that are spaced along gap 172 to further limit the propagation of vibration between support members 154 and 160.

When additional support for panels 18 and 24 is desired, the internal voids between support members 154 and 160 and panels 18 and 24 are filled with insulating material 176 such as mineral wool. Preferably, such insulating material is in granular or similar form such that it can be introduced to fill the voids after the door is partially assembled. In this way, improved sound attenuation can be provided while also facilitating assembly.

It has been found that the capacity of door 10 to attenuate sound is further increased when cover strip 90 is comprised of a material that is flexible and porous such as neoprene rubber or a plastic material of similar physical properties. Cover strip 90 is placed in contact with welds 82 to partially dampen mechanical vibrations that are transmitted therethrough. Preferably cover strip 90 is comprised of a material having a durometer less than 60 and, more preferably, having a density less than 40. It is believed that this construction allows cover strip 90 to further attenuate sound vibrations that might otherwise be transmitted between sides 32 and 38 and sides 34 and 40. While a presently preferred embodiment of the invention disclosed herein has been shown and described, the invention is not limited thereto, but may be otherwise embodied within the scope of the following claims.

We claim:

1. A door assembly comprising a front panel having an interior surface;

a back panel having an interior surface, said back panel being spaced apart from said front panel with the interior surface of said back panel opposing the interior surface of said front panel;

a front connecting member that includes a base segment and an extension segment that is connected to the base segment, the base segment of said front connecting member being in contact with the interior surface of said front panel and secured to the interior surface of said front panel;

a back connecting member that includes a base segment and an extension segment that is connected to the base segment, the base segment of said back connecting member being in contact with the interior surface of said back panel and secured to the interior surface of said back panel, the extension segment of said back connecting member being located opposite from the extension segment of the front connecting member;

means for securing the extension segment of said front connecting member to the extension segment of said back connecting member; and a cover that conceals said securing means, said cover being maintained between the base segment of said front connecting member and the base segment of said back connecting member.

2. The door assembly of claim 1 wherein the base segment of said front connecting member is secured to the interior surface of said front panel by an adhesive and wherein the base segment of said back connecting member is secured to the interior surface of said back panel by an adhesive.

3. The door assembly of claim 1 further comprising:

at least one front support member that is connected to the inner face of said front panel by an adhesive; and at least one back support member that is connected to the inner face of said back panel by an adhesive.

4. The door assembly of claim 3 wherein the front support member has a distal edge that is located remotely from the internal surface of said front panel and wherein the back support member has a distal edge that is located remotely from the internal surface of said back panel, said distal edge of the front support member being secured to the distal edge of the back support member by an adhesive material.

5. The door assembly of claim 3 further including at least one internal brace, said internal brace comprising:

a first support member that is fastened to the interior surface of the front panel by an adhesive and, said first support member having a portion that extends away from the interior surface of the front panel;

a second support member that is fastened to the interior surface of the back panel by an adhesive; and an attenuator strip of porous material, said attenuator strip being connected to the interior projecting portions of the first and second support members.

6. A door assembly comprising:

a front panel having a face and at least one side that is integrally connected to the face, said front panel having an interior surface such that the interior surface of the front panel face cooperates with the interior surface of the front panel side to define an angle therebetween;

a back panel having a face and at least one side that is integrally connected to the face, said back panel having an interior surface such that the interior surface of the back panel face cooperates with the interior surface of the back panel side to define an angle therebetween;

a front connecting member that includes a base segment and an extension segment that is connected to the base segment, the base segment of said front connecting member being in contact with the interior surface of the front panel face and secured to said front panel face;

a back connecting member that includes a base segment and an extension segment that is connected to the base segment, the base segment of said back connecting member being in contact with the interior surface of the back panel face and secured to said back panel, the extension segment of the back connecting member being located opposite from the extension segment of the front connecting member;

means for securing the extension segment of said front connecting member to the extension segment of said back connecting member; and a cover that conceals said securing means, said cover being maintained between the side of said front panel and the side of said back panel.

7. The door assembly of claim 6 wherein the base segment of said front connecting member includes a flange portion that is integrally connected to the front extension segment and a front support member that is secured to the flange portion of the base segment, said front support member also being secured to the interior surface of the front panel, and wherein the base segment of said back connecting member includes a flange portion that is integrally connected to the back extension segment and a back support member that is secured to the flange portion of the base segment, said back support member also being secured to the interior surface of the back panel.

8. The door assembly of claim 6 wherein said extension segment of said front connecting member has a distal end that comprises a front lip and wherein said extension segment of said back connecting member has a distal end that comprises a back lip, said front lip being in contact with said back lip.

9. The door assembly of claim 6 wherein the side of the front panel has a distal edge that is formed in a lip and wherein the side of the back panel has a distal edge that is also formed in a lip, with the lip of said front edge being spaced apart from the lip of said back edge to form a gap therebetween, the width of said gap being smaller than the width of said cover strip such that the cover strip is compressively maintained between the front edge lip and the back edge lip.

10. The door assembly comprising:

a front panel having a face and at least one side that is integrally connected to the face, said front panel having an interior surface and an exterior surface that is oppositely disposed from said interior surface, the interior surface of the front panel face cooperating with the interior surface of the front panel side to define an angle therebetween;

a back panel having a face and at least one side that is integrally connected to the face, said back panel having an interior surface and an exterior surface that is oppositely disposed from said interior surface, the interior surface of the back panel face cooperating with the interior surface of the back panel side to define an angle therebetween;

a front connecting member that is located substantially parallel to the front panel side, said front connecting member including a base segment and an extension segment that is connected to base segment, the base segment of said front connecting member being in contact with the interior surface of the front panel face and secured to said front panel face by an adhesive material;

a back connecting member that is located substantially parallel to the back panel side, said back connecting member including a base segment and an extension segment that is connected to the base segment, the base segment of said back connecting member being in contact with the interior surface of the back panel face and secured to said back panel by an adhesive material, the extension segment of the back connecting member being aligned with the extension segment of the front connecting member;

means for securing the extension segment of said front connecting member to the extension segment of said back connecting member; and a cover that conceals said securing means, said cover being maintained between the edge of said front panel and the edge of said back panel.

* * * * *